US007828056B2

(12) United States Patent
Dybevik et al.

(10) Patent No.: US 7,828,056 B2
(45) Date of Patent: Nov. 9, 2010

(54) METHOD AND APPARATUS FOR CONNECTING SHUNT TUBES TO SAND SCREEN ASSEMBLIES

(75) Inventors: Arthur Dybevik, Sandnes (NO); Knut Nesland, Stavanger (NO); Terje Moen, Sandnes (NO)

(73) Assignee: Schlumberger Technology Corporation, Sugar Land, TX (US)

( * ) Notice: Subject to any disclaimer, the term of this patent is extended or adjusted under 35 U.S.C. 154(b) by 43 days.

(21) Appl. No.: 12/139,752

(22) Filed: Jun. 16, 2008

(65) Prior Publication Data

US 2009/0008084 A1 Jan. 8, 2009

Related U.S. Application Data

(60) Provisional application No. 60/948,308, filed on Jul. 6, 2007.

(51) Int. Cl.
*E21B 43/08* (2006.01)

(52) U.S. Cl. ..... 166/236; 166/51

(58) Field of Classification Search ..... 166/278, 166/51, 227, 236; 29/896.62
See application file for complete search history.

(56) References Cited

U.S. PATENT DOCUMENTS 5,069,280 A 12/1991 McKee
5,309,621 A 5/1994 O'Donnell
5,341,880 A 8/1994 Thorstensen
5,476,143 A * 12/1995 Sparlin et al. ..... 166/233
5,772,261 A * 6/1998 Magram ..... 285/256
6,216,785 B1 4/2001 Achee
6,220,353 B1 4/2001 Foster
6,409,219 B1 * 6/2002 Broome et al. ..... 285/3
6,446,729 B1 9/2002 Bixenman
6,513,599 B1 2/2003 Bixenman
6,575,243 B2 6/2003 Pabst
6,575,246 B2 6/2003 Bixenman
6,581,689 B2 * 6/2003 Hailey, Jr. ..... 166/278
6,605,570 B2 8/2003 Miller
6,695,054 B2 2/2004 Johnson
6,752,206 B2 6/2004 Watson
6,752,207 B2 6/2004 Danos
6,766,857 B2 7/2004 Bixenman
6,789,621 B2 9/2004 Wetzel
6,883,611 B2 4/2005 Smith
7,066,264 B2 6/2006 Bissonnette
7,104,324 B2 9/2006 Wetzel
7,128,152 B2 10/2006 Anyan
7,147,054 B2 12/2006 Wang
7,182,134 B2 2/2007 Wetzel
7,222,676 B2 5/2007 Patel
7,296,624 B2 11/2007 Rodet
7,322,422 B2 1/2008 Patel
7,363,974 B2 4/2008 Wang
2003/0000700 A1 * 1/2003 Hailey, Jr. ..... 166/278
2004/0140089 A1 7/2004 Gunneroed
2005/0092488 A1 5/2005 Rodet
2007/0044964 A1 3/2007 Grigar (Continued)

*Primary Examiner*—William P Neuder
(74) *Attorney, Agent, or Firm*—David Matthews; Rodney Warfford

(57) ABSTRACT

Method and apparatus are disclosed for connecting internal shunt tubes to tubular end components of a sand screen assembly by coupling each end of each shunt tube to ports formed in the tubular end components in an annular space between a base pipe and a filter media using a tubular coupler.

18 Claims, 4 Drawing Sheets

U.S. PATENT DOCUMENTS

2007/0084601 A1 4/2007 Wang
2007/0131421 A1* 6/2007 Hurst et al. ..... 166/278
2007/0227727 A1 10/2007 Patel
2007/0227731 A1 10/2007 Contant
2007/0240881 A1 10/2007 Whitsitt
2007/0251690 A1 11/2007 Whitsitt
2008/0066900 A1 3/2008 Saebi
2008/0164027 A1 7/2008 Sanchez

* cited by examiner

METHOD AND APPARATUS FOR CONNECTING SHUNT TUBES TO SAND SCREEN ASSEMBLIES

RELATED APPLICATIONS

This application claims priority to U.S. Provisional Application No. 60/948,308, filed Jul. 6, 2007, entitled "Manufacturing of Sand Screens."

TECHNICAL FIELD

The present invention relates generally to recovery of hydrocarbons in subterranean formations, and more particularly to tools, systems, and methods for manufacturing of sand screen assemblies.

BACKGROUND

Hydrocarbon fluids such as oil and natural gas are obtained from a subterranean geologic formation, referred to as a reservoir, by drilling a well that penetrates the hydrocarbon-bearing formation. Once a wellbore has been drilled, the well must be completed before hydrocarbons can be produced from the well. A completion involves the design, selection, and installation of equipment and materials in or around the wellbore for conveying, pumping, or controlling the production or injection of fluids. After the well has been completed, production of oil and gas can begin.

Sand or silt flowing into the wellbore from unconsolidated formations can lead to an accumulation of fill within the wellbore, reduced production rates and damage to subsurface production equipment. Migrating sand has the possibility of packing off around the subsurface production equipment, or may enter the production tubing and become carried into the production equipment. Due to its highly abrasive nature, sand contained within production streams can result in the erosion of tubing, flowlines, valves and processing equipment. The problems caused by sand production can significantly increase operational and maintenance expenses and can lead to a total loss of the well.

One means of controlling sand production is the placement of relatively large grain sand (i.e., "gravel") around the exterior of a slotted, perforated, or other type liner or sand screen. The gravel serves as a filter to help assure that formation fines and sand do not migrate with the produced fluids into the wellbore. In a typical gravel pack completion, a sand screen is placed in the wellbore and positioned within the unconsolidated formation that is to be completed for production. The sand screen is typically connected to a tool that includes a production packer and a cross-over, and the tool is in turn connected to a work or production tubing string. The gravel is mixed with a carrier fluid and pumped in slurry form down the tubing and through the crossover, thereby flowing into the annulus between the sand screen and the wellbore. The carrier fluid in the slurry leaks off into the formation and/or through the sand screen. The sand screen is designed to prevent the gravel in the slurry (and other contaminates such as sand and silt) from flowing through it and entering into the production tubing. As a result, the gravel is deposited in the annulus around the sand screen where it forms a gravel pack. It is important to size the gravel for proper containment of the formation sand, and the sand screen must be designed in a manner to prevent the flow of the gravel through the sand screen.

A potential challenge with a conventional gravel packing operation deals with the possibly that fluid may prematurely leave the slurry. This is especially a problem with gravel packing long horizontal or inclined intervals. In these cases, it is difficult to obtain equal distribution of the gravel along the entire completion interval (i.e., completely packing the annulus between the screen and the casing in cased hole completions or between the screen and the wellbore in open hole completions). Poor distribution of the gravel (i.e., incomplete packing of the interval resulting in voids/unpacked areas in the gravel pack) is often caused by the dehydration of the gravel slurry into more permeable portions of the formation interval that, in turn, causes the formation of gravel "bridges" in the annulus before all of the gravel has been placed. These bridges block further flow of the slurry through the annulus causing insufficient placement of the gravel. Subsequently, the portion of the screen that is not covered or packed with gravel is thereby exposed to erosion by the solids in the produced fluids or gas and/or that portion of the screen is then easily blocked or "plugged" by formation particulates (i.e. sand).

U.S. Pat. No. 4,945,991, Jones, L. G., "Method for Gravel Packing Wells" discloses a screen with rectangular perforated shunt tubes attached to the outside of a screen longitudinally over the entire length of the screen. In this method, the perforated shunts (i.e. flow conduits) extend along the length of the screen and are in fluid communication with the gravel slurry as it enters the annulus in the wellbore adjacent the screen to provide an alternate flow path.

In many prior art, alternate flow path well screens, the individual perforated conduits or shunts are shown as being preferably carried externally on the outside surface of the screen; see U.S. Pat. Nos. 4,945,991; 5,082,052; 5,113,935; 5,417,284; and 5,419,394. This positioning of the shunt tubes has worked in a large number of applications, however, these externally-mounted perforated shunts are not only exposed to possible damage during installation but, more importantly, effectively increase the overall diameter of the screen. The latter is extremely important when the screen is to be run in a small diameter wellbore where even fractions of an inch in the effective diameter of the screen may make the screen unusable or at least difficult to install in the well. Also, it is extremely difficult and time consuming to connect respective shunt tubes attached to the outside of the screen to shunt tubes attached to the outside of the following screen in the course of assembling the screens and lowering them into the wellbore.

Moreover, in order to keep the effective diameter of a screen as small as possible, external perforated shunt tubes are typically formed from "flat" rectangular tubing even though it is well-recognized that it is easier and substantially less expensive to manufacture a round tube and that a round tube has a substantially greater and more uniform burst strength than does a comparable rectangular tube.

A disadvantage to mounting the shunt tubes externally, whether they are round or rectangular, is that the shunt tubes are thereby exposed to damage during assembly and installation of the screen. If the shunt tube is crimped during installation or bursts under pressure during operation, it becomes ineffective in delivering the gravel to all levels of the completion interval and may result in the incomplete packing of the interval. One proposal for protecting these shunt tubes is to place them inside the outer surface of the screen; see U.S. Pat. Nos. 5,333,688; 5,476,143 and 5,515,915 and WO2005-031105.

The present invention includes various embodiments of tools and methods for manufacturing sand screen assemblies and particularly for connecting shunt tubes in sand screen assemblies.

SUMMARY

In general, according to certain embodiments of the present invention, a coupler apparatus is provided for use in manufacturing a sand screen assembly, the sand screen assembly including a base pipe connected to an end component, a filter media formed around and external to the base pipe to define an annular space between the base pipe and the filter media, and a shunt tube for connecting to the end component to reside in the annular space. An embodiment of the coupler apparatus includes a tubular body defining an axial bore therethrough adapted to convey a treatment fluid between the shunt tube and a port formed in the end component, the tubular body having a first end adapted to connect with the port of the end component, the tubular body having a second end formed opposite the first end and adapter to connect with the shunt tube.

In general, according to other embodiments of the present invention, a method of manufacturing a sand screen assembly having internal shunt tubes for conveying a treatment fluid includes:

- providing tubular end components, each tubular end component having at least one port formed therein for conveyance of the treatment fluid; and
- arranging a base pipe having an axial bore therethrough between the two tubular end components; and
- connecting one end of a shunt tube to the at least one flow port of one tubular end component using a first coupler; and
- connecting other end of the shunt tube to the at least one flow port of other tubular end component using a second coupler; and
- applying a filter media around the base pipe to form an annular space between the base pipe and filter media wherein resides the shunt tube and couplers.

In general, according to yet other embodiments of the present invention, a coupler apparatus is provided for use in connecting one or more shunt tubes in a sand screen assembly with end components to establish a flow path between ports in the end components and the shunt tubes via the coupler.

In general, according to still other embodiments of the present invention, a sand screen assembly is provided for use downhole in a wellbore, including a base pipe having an axial bore therethrough; a filter media connected to the base pipe defining an annular bore between the base pipe and the filter media; a first tubular end component connected to one end of the base pipe and a second tubular end component connected to the other end of the base pipe, wherein the filter media is arranged between the tubular end components, each tubular end component comprising one or more flow ports adapted to communicate with the annular bore; one or more shunt tubes arranged within the annular bore; and a set of couplers adapted to connect the one or more shunt tubes to the first and second tubular end components, each coupler comprising a first end for connection to an end of a shunt tube and a second end for connection to a flow port of a tubular end component.

Other or alternative embodiments of the present invention will be apparent from the following description, from the drawings, and from the claims.

BRIEF DESCRIPTION OF THE DRAWINGS

The manner in which these objectives and other desirable characteristics can be obtained is explained in the following description and attached drawings in which.

Figure 1:
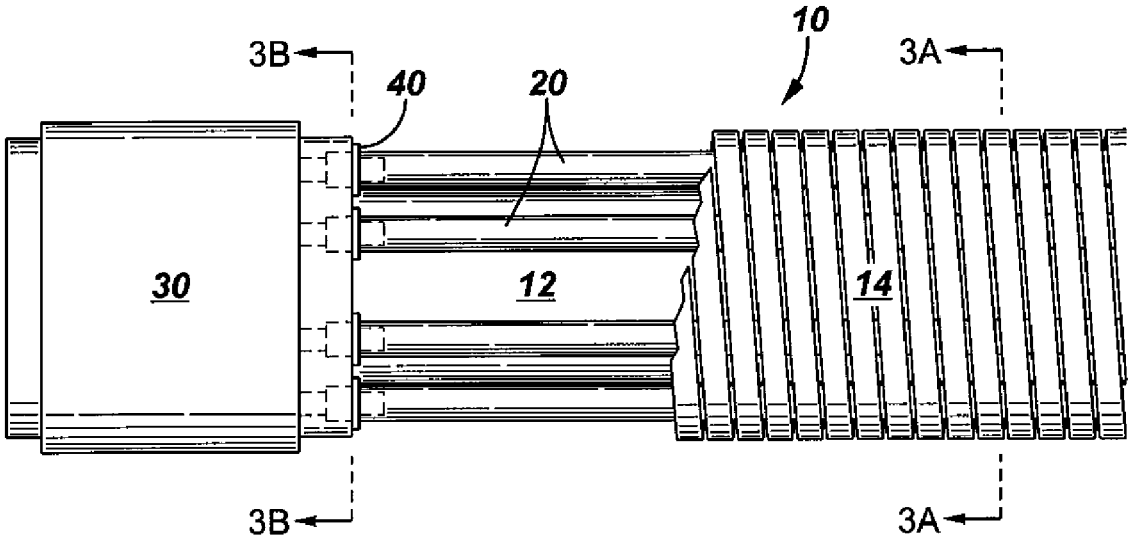
FIG. 1 illustrates a profile cut-away view of a sand screen assembly having shunt tubes connected using a coupler.
Figure 2:
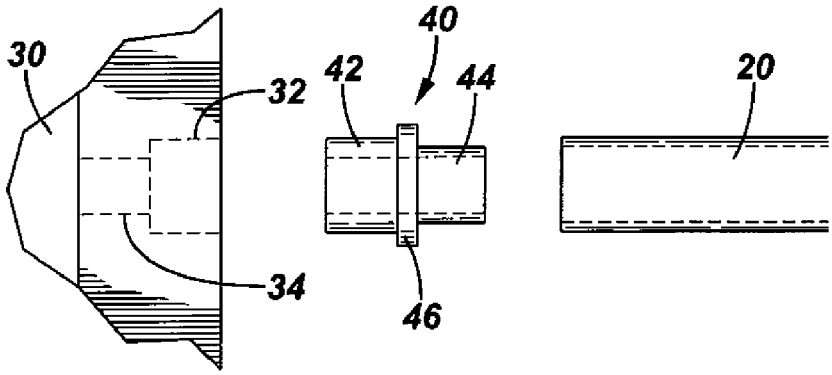
FIG. 2 illustrates an enlarged view of an embodiment of a coupler four use in connecting a shunt tube in a sand screen assembly.
Figure 3A:
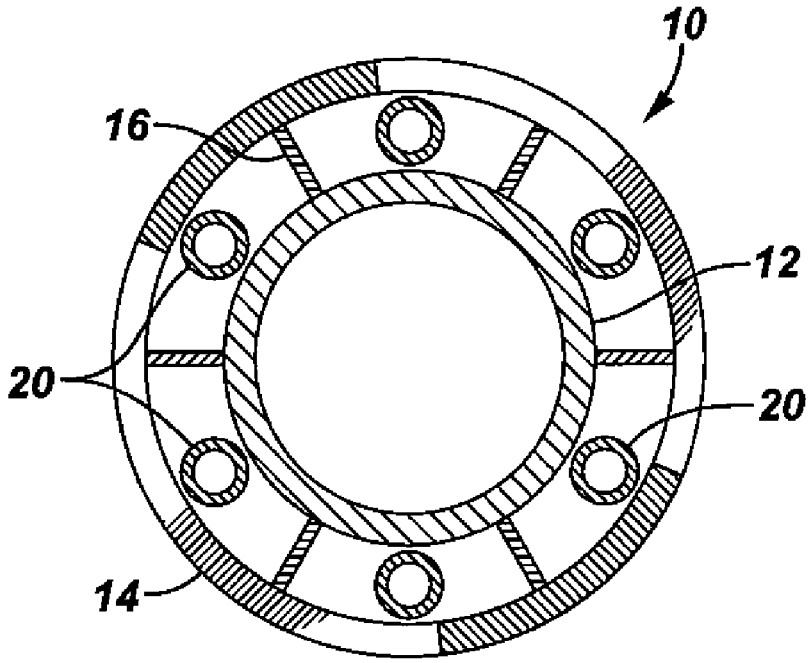
FIGS. 3A-3B illustrate cross-sectional views of the sand screen assembly depicted in FIG. 1.
Figure 3B:
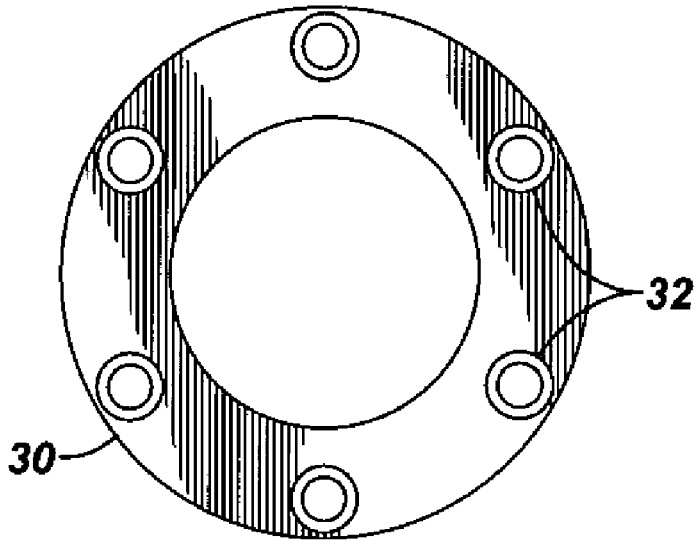

It is to be noted, however, that the appended drawings illustrate only typical embodiments of this invention and are therefore not to be considered limiting of its scope, for the invention may admit to other equally effective embodiments.

DETAILED DESCRIPTION OF THE INVENTION

In the following description, numerous details are set forth to provide an understanding of the present invention. However, it will be understood by those skilled in the art that the present invention may be practiced without these details and that numerous variations or modifications from the described embodiments may be possible.

In the specification and appended claims: the terms "connect", "connection", "connected", "in connection with", and "connecting" are used to mean "in direct connection with" or "in connection with via another element"; and the term "set" is used to mean "one element" or "more than one element". As used herein, the terms "up" and "down", "upper" and "lower", "upwardly" and downwardly", "upstream" and "downstream"; "above" and "below"; and other like terms indicating relative positions above or below a given point or element are used in this description to more clearly describe some embodiments of the invention. Moreover, the term "sealing mechanism" includes: packers, bridge plugs, downhole valves, sliding sleeves, baffle-plug combinations, polished bore receptacle (PBR) seals, and all other methods and devices for temporarily blocking the flow of fluids through the wellbore. Furthermore, while the term "coiled tubing" is used throughout, it could actually be replaced by jointed tubing or any relatively small diameter tubing for running downhole.

Generally, various embodiments of the present invention include apparatus and methods for manufacturing sand screen assemblies incorporating shunt tubes. More particularly, embodiments of the present invention include methods to make-up a sand screen assembly by connecting shunt tubes to shunt passages in end components (e.g., termination rings, end rings, load sleeves, torque sleeves, and inflow control device rings and nozzle rings) using a coupler.

With reference to FIGS. 1, 2, 3A and 3B, a sand screen assembly 10 is provided having one or more internal shunt tubes 20. A section of the sand screen assembly 10 includes a base pipe 12 and a wire-wrapped filtering media 14 arranged external the base pipe is connected between two end components 30. The wire-wrapped filtering media 14 is generally welded to a set of ribs 16 which are formed or welded onto the outer surface of the base pipe 12. A set of one or more shunt tubes 20 is arranged between the inner base pipe 12 and the wire-wrapped filtering media 14. The shunt tubes 20 may be positioned between the ribs 16. Each shunt tube 20 is connected to an end component 30 via a coupler 40 which completes a flow path between the shunt tube bore and a corresponding bore 34 through the end component 30. The coupler 40 includes a first mating end 42 for connecting to a recess 32 in the end component 30 aligned with the port 34, and a second mating end for connecting to the bore of the shunt tube 20. The first mating end 42 is sized externally to fit within the inner surface of the port 32. The second mating end 42 is sized externally to fit within the inner bore of the shunt tube 20. In alternative embodiments, the second mating end may be sized internally to fit around the outer surface of the shunt tube. Moreover, while the present embodiment includes a wire-wrapped filtering media, other embodiments include other filtering media including wire-mesh filters, slotted tubes, and so forth.

Figure 4A:
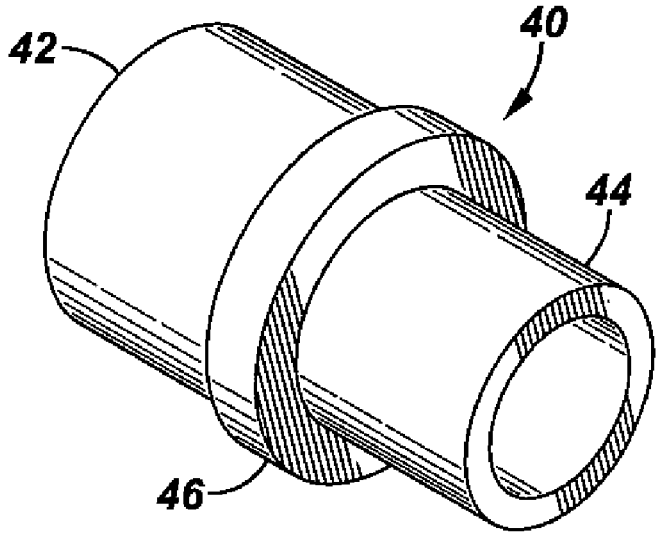
FIG. 4A illustrates an isometric view of an embodiment of a coupler for use in connecting shunt tubes in sand screen assemblies.
Figure 4B:
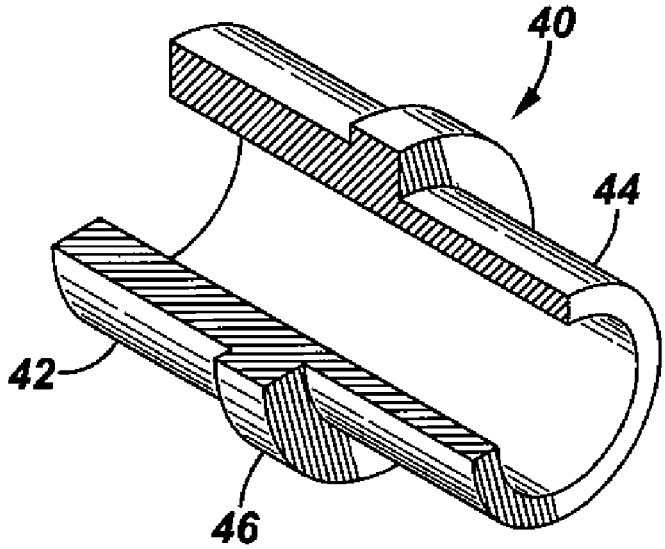
FIG. 4B illustrates an isometric cut-away view of an embodiment of a coupler for use in connecting shunt tubes in sand screen assemblies.

With respect to FIGS. 4A-4B, an embodiment of the coupler 40 is tubular and defines an axial bore therethrough for establishing hydraulic communication between the inner bore of a shunt tube and the corresponding flow paths through a sand screen end component. These end components may be used to connect a sand screen section to other sand screens or to other lower completions accessories. The flow paths may connect multiple sand screen assemblies or otherwise lead to alternative flow paths to the well annulus. The coupler 40 further includes a first end 42 for connecting to an end component, a second end 44 for connecting to a shunt tube, and a stop element 46 for engaging the face of the sand screen end component on one side and the leading edge of the shunt tube on the other side. In some embodiments, an end of the coupler is connected to a shunt tube/end component forming pressure-fit metal-to-metal connection. In still another embodiment, the coupler is sized such that the ends have the same external diameter as the inner diameter of the shunt tube and the inner diameter of the port of the end component flow bore. The coupler is then heated to shrink and hammered (or otherwise forced) into connection with the shunt tube and end component. As the coupler cools and expands, it forms a tight metal-to-metal seal. In still other embodiments, an end of the coupler is connected to a shunt tube/end component using glue, epoxy, or other adhesive to fix the connection.

Figure 5:
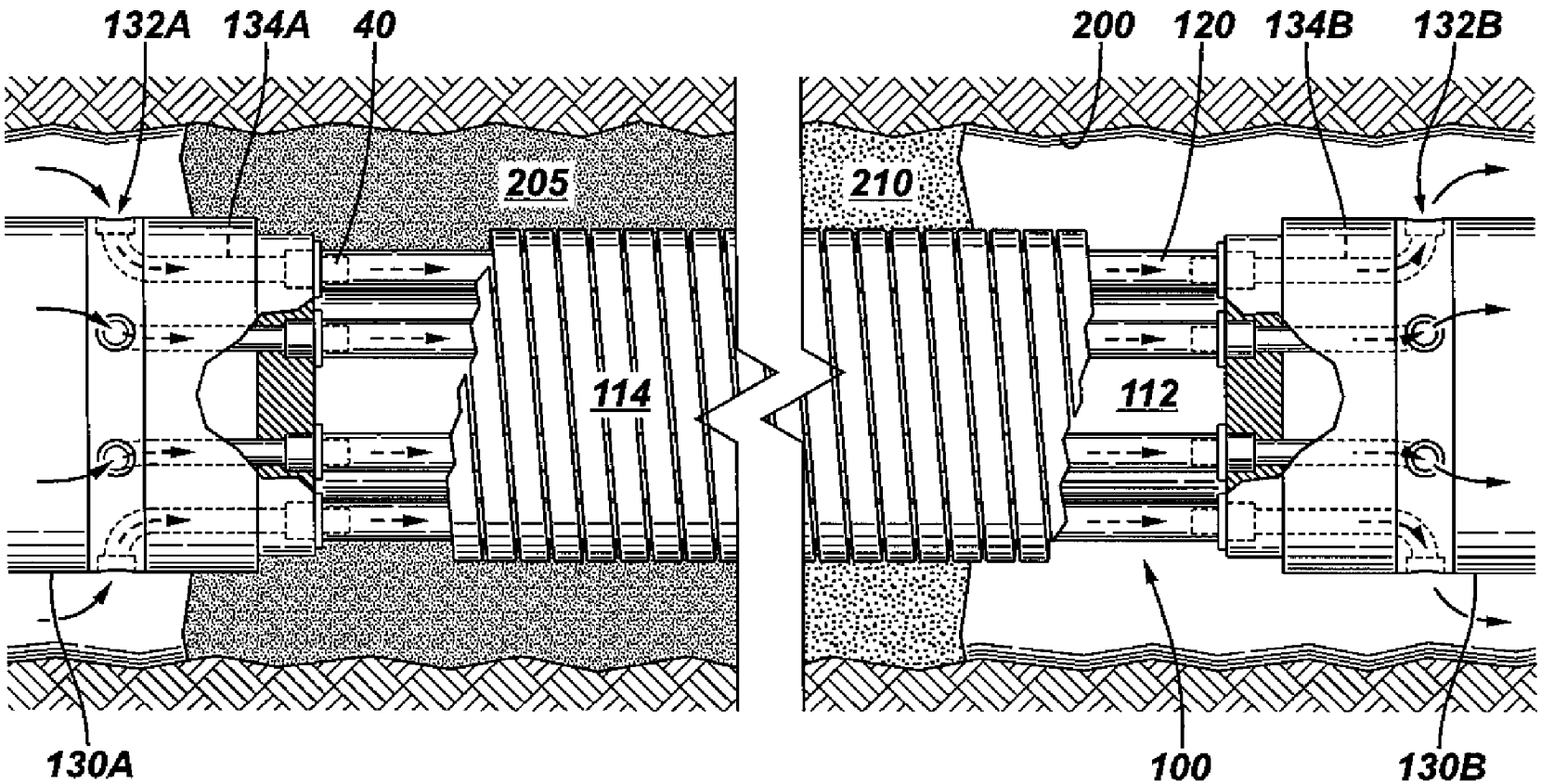
FIG. 5 illustrates a flow path for gravel slurry through an embodiment of a sand screen assembly.

With reference to FIG. 5, in operation, a sand screen assembly 100 in accordance with various embodiments of the present invention, provides an alternate flow path for treatment of a target section of wellbore 200. The sand screen assembly 100 is deployed in a wellbore 200 at a target section (e.g., at a production reservoir). Typically, a treatment fluid, such as gravel slurry 205 (comprising gravel and a carrier fluid), is pumped down a tubing (not shown) and downward into the wellbore annulus via a crossover tool (not shown). As the gravel slurry 205 is deployed and the carrier fluid is returned to the surface after it returns through the screen 114 and base pipe 112, a gravel bridge 210 may unexpectedly form. This bridge 210 may create a gravel void downhole. In such a case, an alternate flow path is provided. For example, the alternate flow path of gravel slurry may include: (1) flowing from annulus of wellbore 200 above bridge 210 into conduits 134A of screen component 130A via shunt entrance ports 132A; (2) flowing into the shunt tubes 120 via couplers 40; (3) flowing into conduits 134B of screen component 130B via couplers 40; and (4) back into annulus of wellbore 200 below bridge 210 via shunt exit ports 132B.

While the invention has been disclosed with respect to a limited number of embodiments, those skilled in the art will appreciate numerous modifications and variations therefrom. It is intended that the appended claims cover such modifications and variations as fall within the true spirit and scope of the invention.

What is claimed is:

1. A sand screen assembly for use downhole in a wellbore, comprising:

a base pipe having an axial bore therethrough;

a filter media connected to the base pipe defining an annular bore between the base pipe and the filter media;

a first tubular end component connected to one end of the base pipe and substantially coaxially aligned therewith, and a second tubular end component connected to the other end of the base pipe and substantially coaxially aligned therewith, wherein the filter media is arranged between the tubular end components, each tubular end component comprising one or more flow ports adapted to communicate with the annular bore;

one or more shunt tubes arranged within the annular bore; and a set of couplers adapted to connect the one or more shunt tubes to the first and second tubular end components, each coupler comprising a first end for connection to an end of a shunt tube and a second end for connection to the one or more flow ports of the first and second tubular end components, wherein the one or more flow ports are defined in the first and second tubular end components.

2. The sand screen assembly of claim 1, wherein each coupler is adapted to form a metal-to-metal seal with one of the one or more shunt tubes and the flow port in the first or second tubular end component.

3. The sand screen assembly of claim 1, further comprising:

an adhesive adapted to seal each coupler between a shunt tube and a flow port of a tubular end component.

4. The sand screen assembly of claim 1, wherein each tubular end component is one selected from the group consisting of: a termination ring, an end ring, a load sleeve, a torque sleeve, an inflow control device ring, and a nozzle ring.

5. The sand screen assembly of claim 1, wherein the second end of each of the couplers is sized to be received into the first or second tubular end component.

6. The sand screen assembly of claim 5, wherein the first end of each of the couplers is sized to be received into one of the one or more shunt tubes.

7. The sand screen assembly of claim 1, wherein each coupler further comprises a stop element having a first side that engages the end of one of the one or more shunt tubes.

8. The sand screen assembly of claim 7, wherein the stop element of each of the couplers is disposed on a radial outside thereof, and has a second side that engages a face of one of the tubular end components.

9. A method of manufacturing a sand screen assembly, comprising:

providing first and second tubular end components, each tubular end component having at least one port formed therein for conveyance of a fluid;

arranging a base pipe having an axial bore therethrough between the first and second tubular end components such that the base pipe and the first and second tubular end components are substantially coaxially aligned;

connecting a first end of a shunt tube to the at least one flow port of the first tubular end component using a first coupler;

engaging a face of the first tubular end component with a stop element of the first coupler;

connecting a second end of the shunt tube to the at least one flow port of the second tubular end component using a second coupler;

engaging a face of the second tubular end component with a stop element of the second coupler; and applying a filter media around the base pipe to form an annular space between the base pipe and filter media wherein resides the shunt tube and first and second couplers.

10. The method of claim 9, wherein connecting the ends of the shunt tube to the first and second tubular end components comprises:

establishing a flow path between the at least one flow port of the first and second tubular end components and the shunt tube.

11. The method of claim 9, wherein connecting the ends of the shunt tube to the tubular end components comprises:

heating each coupler;

forcing one end of the coupler into the at least one flow port of one of the tubular end components;

forcing the other end of the coupler into one end of the shunt tube; and cooling the coupler to form a metal-to-metal seal between the tubular end component and the shunt tube.

12. The method of claim 9, wherein connecting the ends of the shunt tube to the tubular end components comprises:

applying an adhesive between one end of each coupler and one end of the shunt tube to seal the coupler to the shunt tube; and applying an adhesive between the other end of each coupler and the at least one flow port of one of the tubular end components to seal the coupler to the tubular end component.

13. The method of claim 9, further comprising:

engaging one end of the shunt tube with the stop element of the first coupler; and engaging the other end of the shunt tube with the stop element of the second coupler.

14. The method of claim 13, further comprising:

sizing one side of each of the first and second couplers to be received into the flow port of one of the tubular end components; and sizing the other side of each of the first and second couplers to be received into the shunt tube.

15. Coupler apparatus for use in manufacturing a sand screen assembly, the sand screen assembly comprising a base pipe connected to an end component, a filter media formed around and external to the base pipe to define an annular space between the base pipe and the filter media, and a shunt tube for connecting to the end component to reside in the annular space, the coupler apparatus comprising:

a tubular body defining an axial bore therethrough adapted to convey a fluid between the shunt tube and a port formed in the end component, the tubular body having a first end adapted to connect with the port of the end component, the tubular body having a second end formed opposite the first end and adapted to connect with the shunt tube, and the tubular body having a stop element adapted to engage an end of the shunt tube.

16. The coupler apparatus of claim 15, wherein the first end is received into the port of the end component and the second end is received into the shunt tube.

17. The coupler apparatus of claim 16, wherein the stop element is disposed on a radial outside of the tubular body.

18. The coupler apparatus of claim 17, wherein the stop element is adapted to engage a face of the end component.

* * * * *